US009644299B2

(12) United States Patent
Berglund et al.

(10) Patent No.: US 9,644,299 B2
(45) Date of Patent: May 9, 2017

(54) CLOTHES TREATING APPARATUS AND METHOD

(71) Applicants: David N. Berglund, Charlotte, NC (US); Eskil Eriksson, Macedonia, OH (US); Robert Smerling, Los Angeles, CA (US)

(72) Inventors: David N. Berglund, Charlotte, NC (US); Eskil Eriksson, Macedonia, OH (US); Robert Smerling, Los Angeles, CA (US)

(73) Assignee: CleanLOGIC LLC, Los Angeles, CA (US)

( * ) Notice: Subject to any disclaimer, the term of this patent is extended or adjusted under 35 U.S.C. 154(b) by 41 days.

(21) Appl. No.: 14/382,903

(22) PCT Filed: Mar. 5, 2013

(86) PCT No.: PCT/US2013/029112
§ 371 (c)(1),
(2) Date: Sep. 4, 2014

(87) PCT Pub. No.: WO2013/134258
PCT Pub. Date: Sep. 12, 2013

(65) Prior Publication Data

US 2015/0082552 A1 Mar. 26, 2015

Related U.S. Application Data

(60) Provisional application No. 61/606,778, filed on Mar. 5, 2012.

(51) Int. Cl.
*D06F 13/04* (2006.01)
*D06F 13/00* (2006.01)

(52) U.S. Cl.
CPC ..... *D06F 13/04* (2013.01); *D06F 13/00* (2013.01)

(58) Field of Classification Search
CPC ..... D06F 13/00; D06F 13/04
See application file for complete search history.

(56) References Cited

U.S. PATENT DOCUMENTS 2,144,157 A * 1/1939 Jorgenson ..... D06F 43/00 210/153
3,195,328 A * 7/1965 Mantell ..... D06F 13/00 4/255.12

(Continued)

FOREIGN PATENT DOCUMENTS

CN 101597852 7/2011
GB 420145 11/1934

(Continued)

OTHER PUBLICATIONS

Machine Translation of CN 101597852 to Guo, Jul. 2011.*

(Continued)

*Primary Examiner* — Michael Barr
*Assistant Examiner* — Benjamin L Osterhout
(74) *Attorney, Agent, or Firm* — David L. Hoffman; Hoffman Patent Group

(57) ABSTRACT

A clothes treating system includes a treating chamber for receiving clothes and a treating fluid therein, and a piston having a piston head. The piston can be adapted for reciprocating linear motion. Reciprocating motion of the piston head within the chamber agitates the clothes. An inner false wall can be contained within the chamber, and can have a corrugated surface providing frictional agitation of the clothes as the clothes are moved against the corrugated surface by the reciprocal motion of the piston head.

23 Claims, 11 Drawing Sheets

(56) References Cited

U.S. PATENT DOCUMENTS

| | | | | |
|---|---|---|---|---|
| 4,976,119 | A * | 12/1990 | Hartmann | D06F 47/00 100/116 |
| 5,301,379 | A | 4/1994 | Schaal | |
| 5,421,049 | A | 6/1995 | Hendren | |
| 5,467,492 | A | 11/1995 | Chao et al. | |
| 5,904,737 | A | 5/1999 | Preston et al. | |
| 5,953,780 | A | 9/1999 | Schollmeyer et al. | |
| 6,216,302 | B1 | 4/2001 | Preston et al. | |
| 6,261,326 | B1 | 7/2001 | Hendrix et al. | |
| 6,442,980 | B2 | 9/2002 | Preston et al. | |
| 6,776,801 | B2 | 8/2004 | Berglund | |
| 6,851,148 | B2 | 2/2005 | Preston et al. | |
| 2008/0155759 | A1 | 7/2008 | Mantle et al. | |

FOREIGN PATENT DOCUMENTS

| | | |
|---|---|---|
| SU | 18713 | 1/1931 |
| SU | 513135 | 5/1976 |

OTHER PUBLICATIONS

International Search Report for International Application No. PCT/US2013/029112.

International Preliminary Report on Patentability for International Application No. PCT/US2013/029112.

* cited by examiner

CLOTHES TREATING APPARATUS AND METHOD

CROSS REFERENCE TO RELATED APPLICATIONS

This application claims priority to U.S. Provisional Application No. 61/606,778, filed Mar. 5, 2012, which is incorporated herein.

TECHNICAL FIELD AND BACKGROUND OF THE INVENTION

The present invention relates to an apparatus and method for treating a variety of items. An embodiment of the invention comprises an apparatus for cleaning launderable items, such as clothing, towels, linens, table cloths, bedding and the like, utilizing piston agitation.

SUMMARY OF THE INVENTION

One object of the present invention is to provide a clothes treating apparatus comprising a cleaning chamber in which linear reciprocating movement of a piston agitates clothes within the chamber. Another object of the invention is to provide a dual mode treating apparatus operable in both dry cleaning and water washing modes. These and other objects of the invention can be achieved in the preferred embodiments of the invention described below.

According to one embodiment of the invention, an apparatus for cleaning clothes comprises a cleaning chamber adapted for receiving and containing clothes and a cleaning fluid therein, and a piston having a piston head positioned within the cleaning chamber adapted for reciprocating motion within the cleaning chamber. The reciprocal motion of the piston head agitates the clothes contained within the cleaning chamber whereby facilitating cleaning of the clothes.

According to another embodiment of the invention, the piston is adapted for reciprocal linear motion within the cleaning chamber such that the piston head moves in a first linear motion that compresses the clothes within the cleaning chamber, and in a second linear motion opposite to the first linear motion that allows the clothes within the cleaning chamber to expand.

According to another embodiment of the invention, the apparatus includes an inner wall positioned within the cleaning chamber. The inner wall defines a clothes receiving area for receiving and containing the clothes therein, and has a corrugated surface facing the clothes receiving area. As such, the corrugated surface of the inner wall provides frictional agitation of the clothes as the clothes are moved against the corrugated surface by the reciprocal motion of the piston head. A tangential flow of the cleaning fluid imparts a centripetal force on the clothes, such that the clothes are moved toward the corrugated surface of the inner wall.

According to another embodiment of the invention, the cleaning chamber includes an outer wall surrounding the inner wall, such that the inner wall and the outer wall define an intermediate area there between.

According to another embodiment of the invention, the cleaning chamber is substantially cylindrical and includes an upper opening for receiving the clothes therethrough, and a lower opening opposed to the first opening. An elongate section is in communication with the lower opening, and a portion of the piston is positioned within the elongate section.

According to another embodiment of the invention, a moveable door covering the upper opening for selectively opening and closing the cleaning chamber.

According to another embodiment of the invention, a first check valve is positioned in the intermediate area between the outer wall and the inner wall, and a second check valve positioned on the piston head. The first and second check valves aid in regulating flow of cleaning fluid within the cleaning chamber.

According to another embodiment of the invention, the first check valve opens and the second check valve closes when the piston head moves away from the upper opening, and the first check valve closes and the second check valve opens when the piston head moves toward the upper opening.

According to another embodiment of the invention, the cleaning fluid is selected from the group consisting of a dry cleaning solvent and a water based cleaning formulation. As such, the apparatus is operable in dry cleaning and water wash modes.

According to another embodiment of the invention, a storage tank for storing the cleaning fluid is in communication with the cleaning chamber, and a still is positioned above the storage tank. The still is in communication with the cleaning chamber for receiving used cleaning fluid.

According to another embodiment of the invention, the cleaning fluid comprises a dry cleaning solvent, and the cleaning solvent in the storage tank is hotter than the used cleaning solvent in the still. As such, heat from the storage tank evaporates the used liquid cleaning solvent in the still producing clean gaseous solvent, and particulate residue. An exit tube is connected to the still for exiting the particulate residue.

According to another embodiment of the invention, the cleaning solvent is comprised of liquid carbon dioxide.

According to another embodiment of the invention, a clothes treating system comprises a treating chamber for receiving a treating fluid therein, and having a first wall defining a clothes receiving area for receiving and containing clothes therein. The first wall has a corrugated surface facing the clothes receiving area. A piston has a piston head that is positioned within the clothes receiving area. The piston is adapted for reciprocating motion, so that the piston head moves in reciprocating motion within the clothes receiving area, thereby agitating the clothes. In addition, the corrugated surface of the first wall provides frictional agitation of the clothes as the clothes are moved against the corrugated surface by the reciprocal motion of the piston head.

According to another embodiment of the invention, the piston is adapted for reciprocal linear motion, such that the piston head slides back and forth within the clothes receiving area. The piston head includes a corrugated outer edge adapted for complimentary sliding engagement with the corrugated surface of the first wall.

According to another embodiment of the invention, the system includes a storage tank for storing the treating fluid. The tank is in communication with the treating chamber, and the treating fluid is comprised of a dry cleaning solvent, such as liquid carbon dioxide. A still is positioned above the storage tank, and is in communication with the cleaning chamber for receiving used cleaning solvent. The cleaning solvent in the storage tank is hotter than the used solvent in the still, and heat from the storage tank evaporates the used liquid solvent in the still producing clean gaseous solvent, and particulate residue.

According to another embodiment of the invention, the treating chamber comprises a second wall that is an outer wall surrounding the first wall. The first wall is an inner false wall contained within the outer wall, and the inner false wall and the outer wall define an intermediate area there between.

According to another embodiment of the invention, a compressor is operatively connected to the treating chamber for moving the treating fluid throughout the system. The compressor is lubricated by a detergent.

According to another embodiment of the invention, a method of treating clothes with a cleaning fluid includes providing an apparatus comprising a cleaning chamber adapted for receiving and containing clothes and a cleaning fluid therein. The chamber has an opening for receiving clothes therethrough, and a moveable door covers the chamber opening for selectively opening and closing the opening. A piston having a piston head positioned within the cleaning chamber is adapted for reciprocating linear motion within the cleaning chamber. A storage tank stores the cleaning fluid, and is in communication with the cleaning chamber. A still is positioned above the storage tank in communication with the cleaning chamber for receiving used cleaning solvent. The door is opened, and clothes are introduced through the chamber opening. The door is closed, and cleaning fluid from the storage tank is introduced into the cleaning chamber. The piston head moves in reciprocal linear motion within the cleaning chamber to agitate the clothes within the chamber.

According to another embodiment of the invention, the door is opened after the clothes are cleaned, and the piston head is moved toward the chamber opening, thereby pushing the cleaned clothes out of the chamber.

DESCRIPTION OF PREFERRED EMBODIMENTS OF THE INVENTION AND BEST MODE

Figure 1:
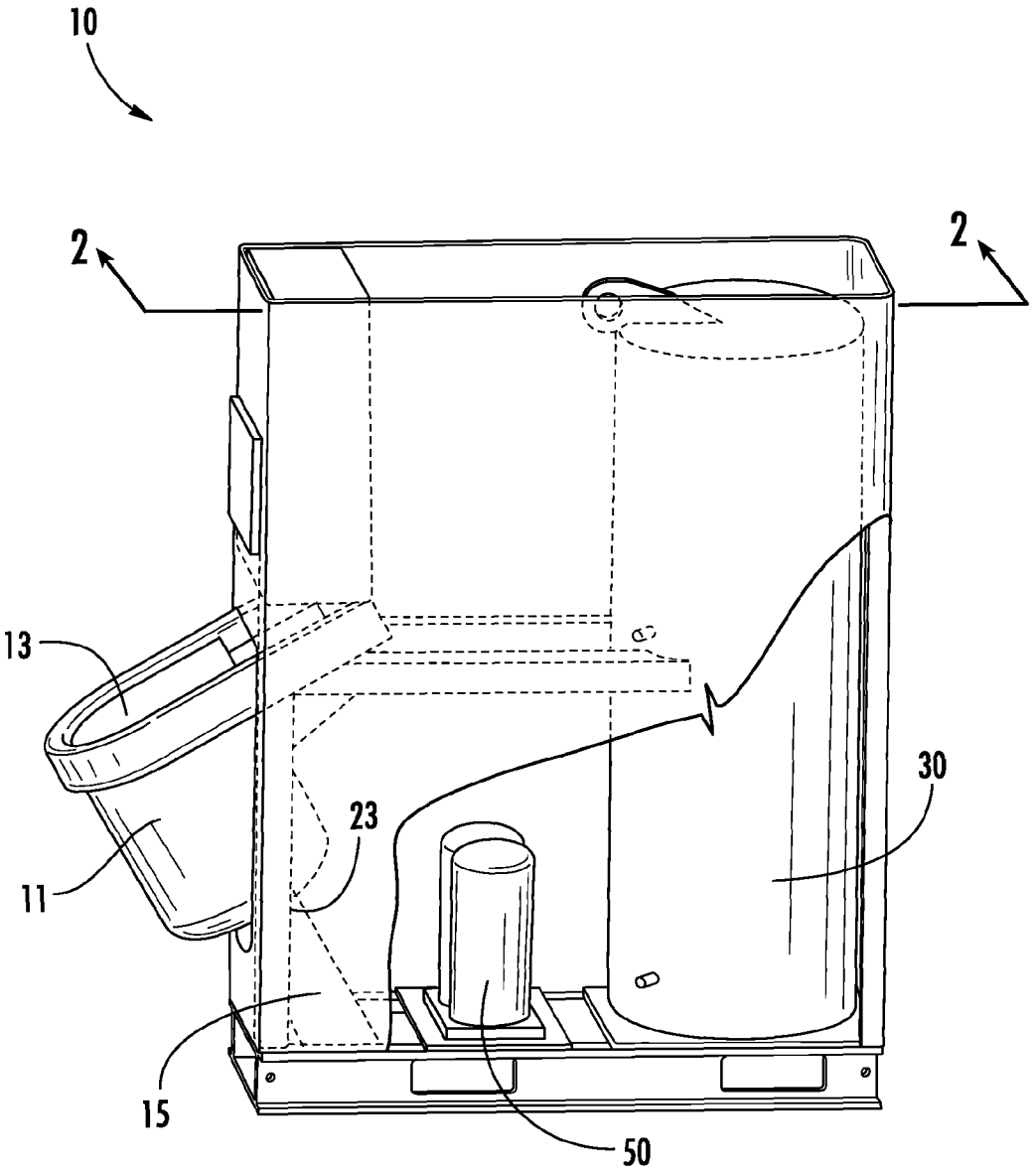
FIG. 1 is a side elevation of a clothes treating system according to a preferred embodiment of the invention.
Figure 2:
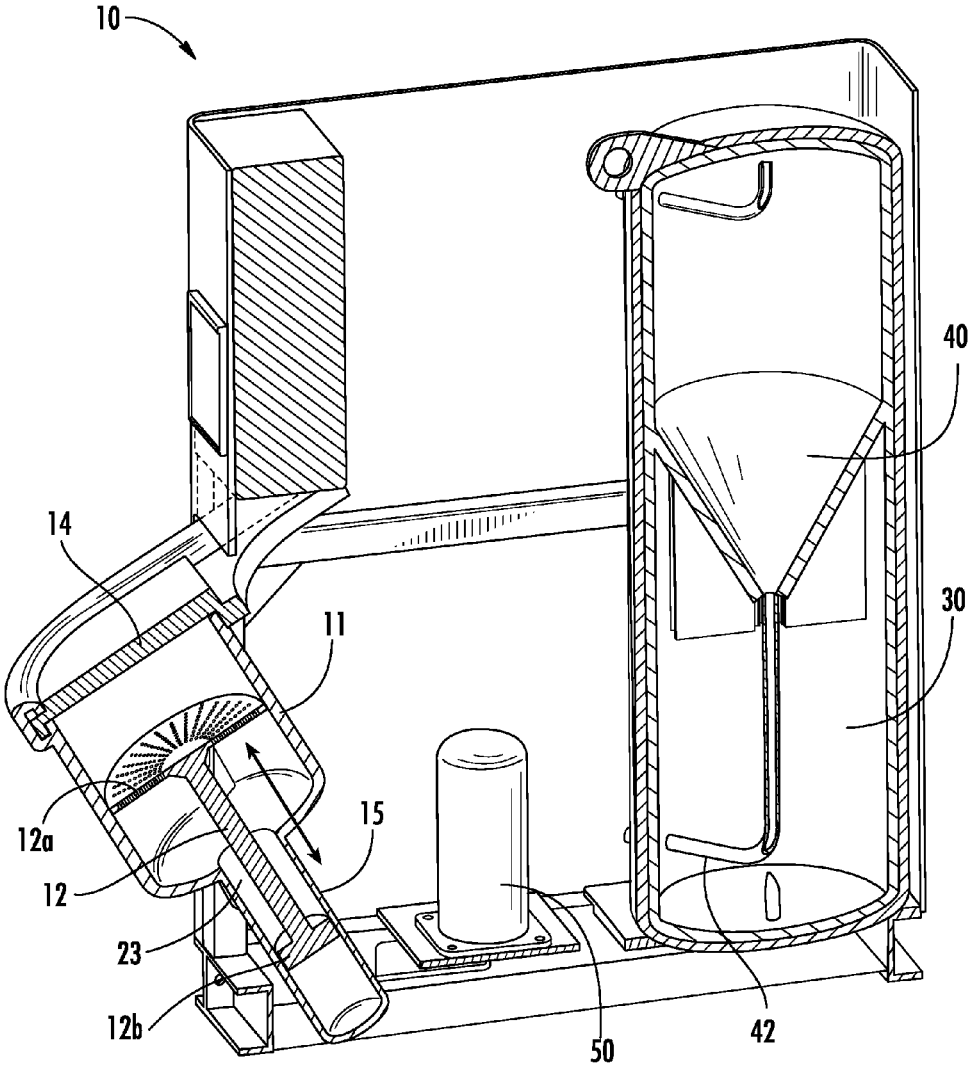
FIG. 2 is a cross sectional view taken along lines 2-2 of FIG. 1.

A cleaning system according to a preferred embodiment of the invention is illustrated in FIGS. 1-7, and shown generally at reference numeral 10. As shown in FIGS. 1 and 2, the system 10 includes a cleaning chamber 11 for receiving and containing clothes therein, with a piston 12 positioned within the chamber 11 for agitating the clothes. As used throughout this application, the terms "clothes" and/or "clothing" are not limited only to garments worn on the body, but refer generally to any items that can be dry cleaned and/or washed with water, such as towels, linens, table cloths, bedding, apparel and the like.

As shown in FIG. 2, the system 10 can include a storage tank 30 for storing a treating fluid to be supplied to the cleaning chamber 11. "Treating fluid" as used throughout this application, refers generally to any fluid used to alter the condition and/or characteristics of the clothes in any manner, such as a cleaning fluid used to clean clothes and/or a dye for dying clothes. The cleaning fluid can be a dry cleaning solvent such as liquid carbon dioxide (liq$CO_2$). A still 40 is positioned above the storage tank 30 for receiving used dirty solvent.

Figure 3:
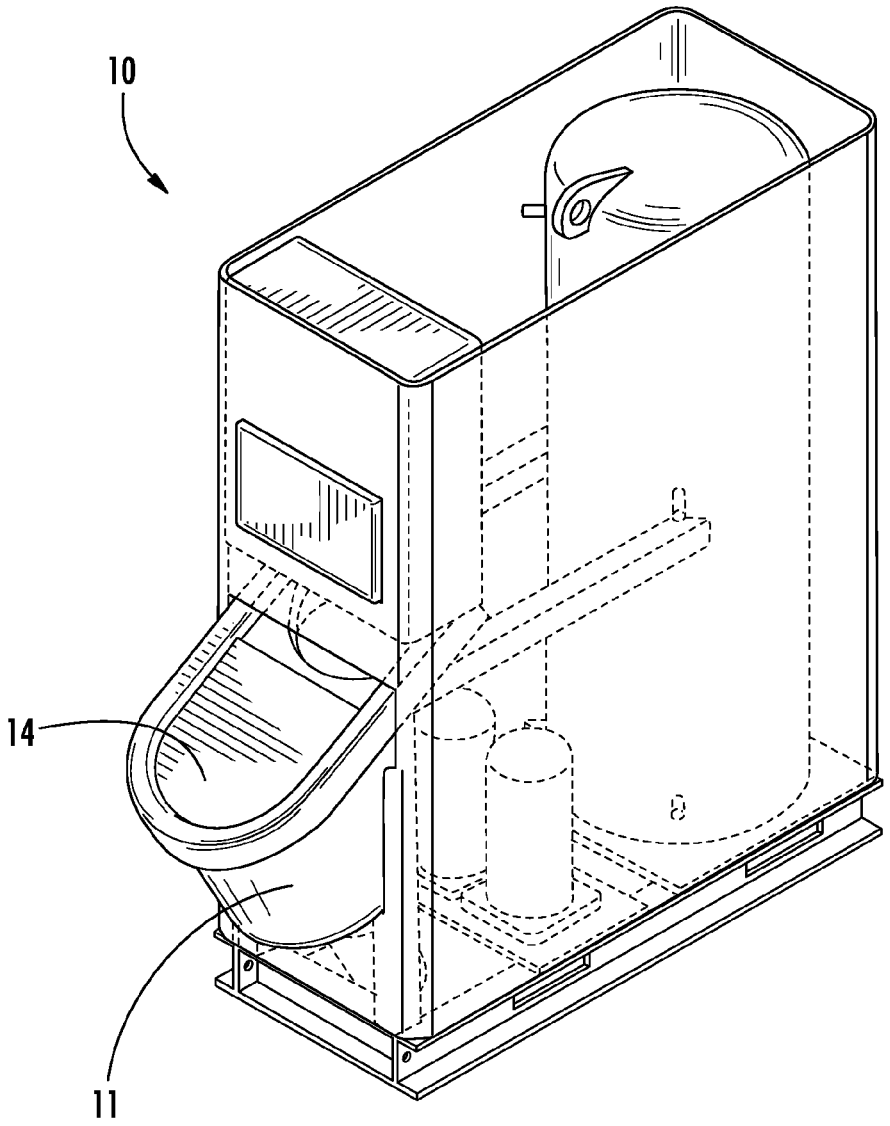
FIG. 3 is a perspective view of the system of FIG. 1.
Figure 4:
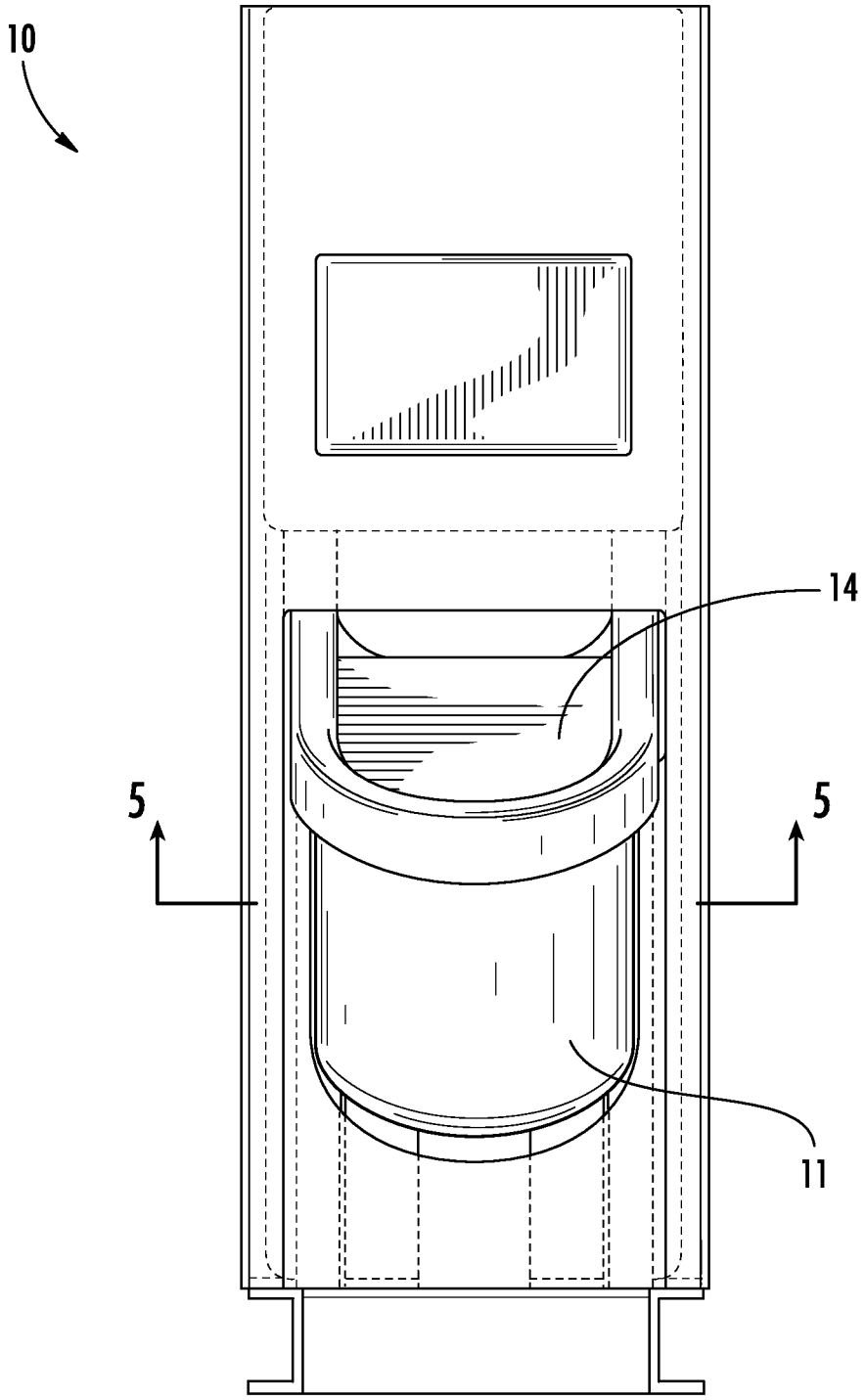
FIG. 4 is a front elevation of the system of FIG. 1.

As shown in FIG. 1, the cleaning chamber 11 can be substantially cylindrical and defines an upper opening 13 for receiving items such as clothes to be treated by the system 10. As shown in FIGS. 2 and 3, a moveable door 14 covers the opening 14 to selectively open and close the chamber 11. The chamber 11 includes a lower opening 23 that communicates with an elongate section 15. The piston head 12*a* is positioned within the chamber 11, and the lower end of the piston 12*b* is positioned within the elongate section 15 for linear sliding movement within the section 15.

The system 10 includes a gas compressor 50 for moving the cleaning fluid throughout the system 10. Preferably, an ester based detergent is used as a lubricant for the compressor 50, rather than oil based lubricants. A factor in controlling good and consistent $CO_2$ cleaning quality is "detergent injection," i.e. the addition of something to the liq$CO_2$ in order to improve cleaning. By using an ester based detergent lubricant (which improves the hydrophobic cleaning capacity of $CO_2$ as compressor lubricant, the system 10 could include a deliberate and controlled compressor lubricant leakage into the cleaning fluid as detergent injection. Advantages can include lubrication of the compressor, elimination of a need for a specific (high pressure) detergent injection system, and any unintentional leak of the detergent lubricant into the cleaning fluid would not be problematic.

Propulsion of the piston 12 can also be powered by the compressor 50 functionally connected to the elongate section 15. It should be noted that the linear actuation of piston 12 can be powered by any method of power transmission, such as hydraulic, pneumatic, or electric, with appropriate mechanical linkage. As such, the piston 12 can move in reciprocal linear motion within the chamber 11.

Figure 11:
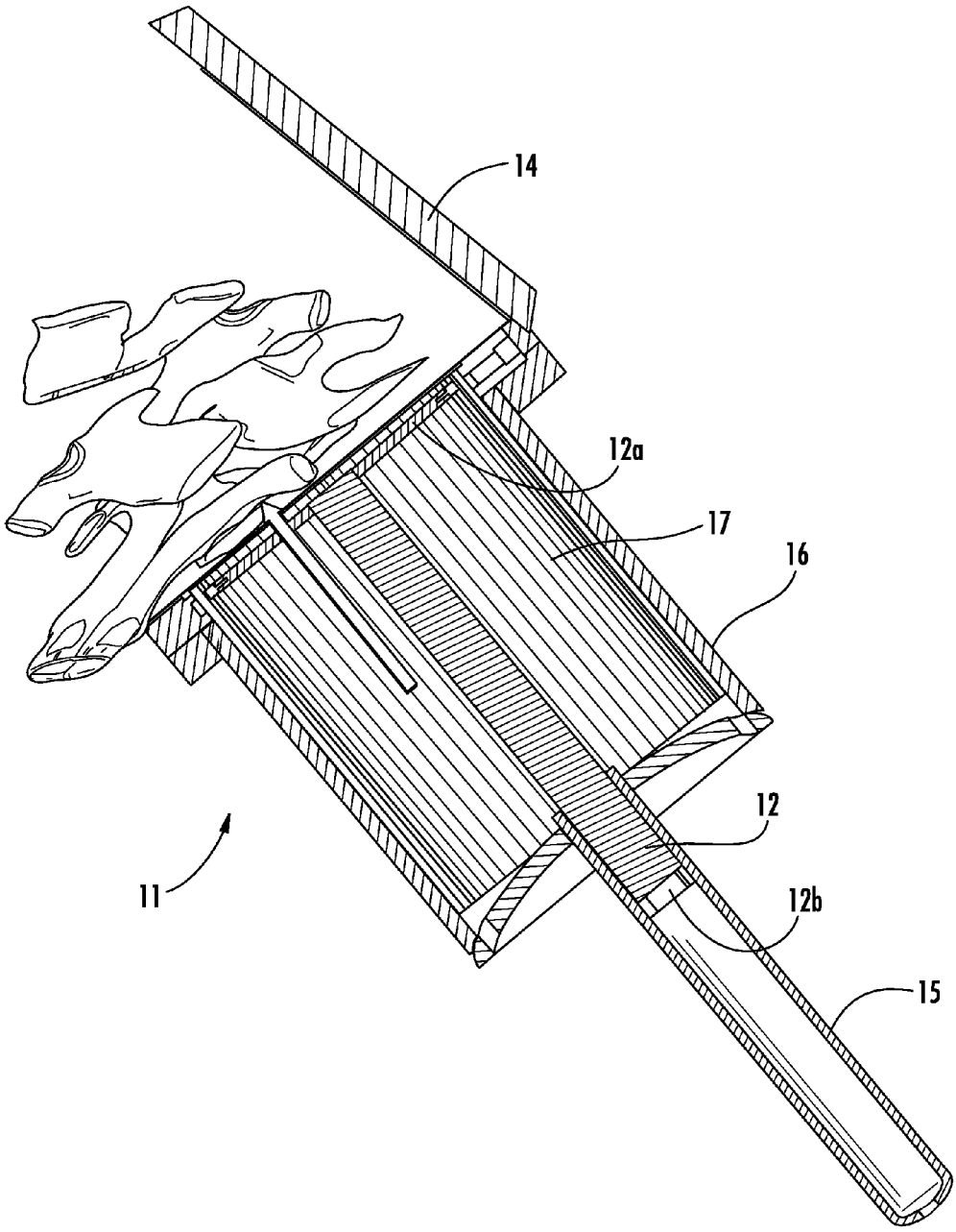
FIG. 11 is another cross sectional view of the cleaning chamber of the system of FIG. 1.

The door 14 can be opened and clothes are placed in the cleaning chamber 11 through the upper opening 13. The door 14 is closed, and a cleaning solvent such as liq$CO_2$ can be introduced into the cleaning chamber 11. The clothes in the chamber are cleaned by agitation of the reciprocal linear motion of the piston 12. When the cleaning process is complete, the door 14 can be opened and the cleaned clothes can be removed by movement of the piston 12*a* pushing the clothes up the chamber 11 and out the upper opening 13, as shown in FIG. 11. By automating the step of removing cleaned clothes from the cleaning chamber, the risk of injuries to workers who would otherwise be required to perform this task by hand is reduced.

Figure 5:
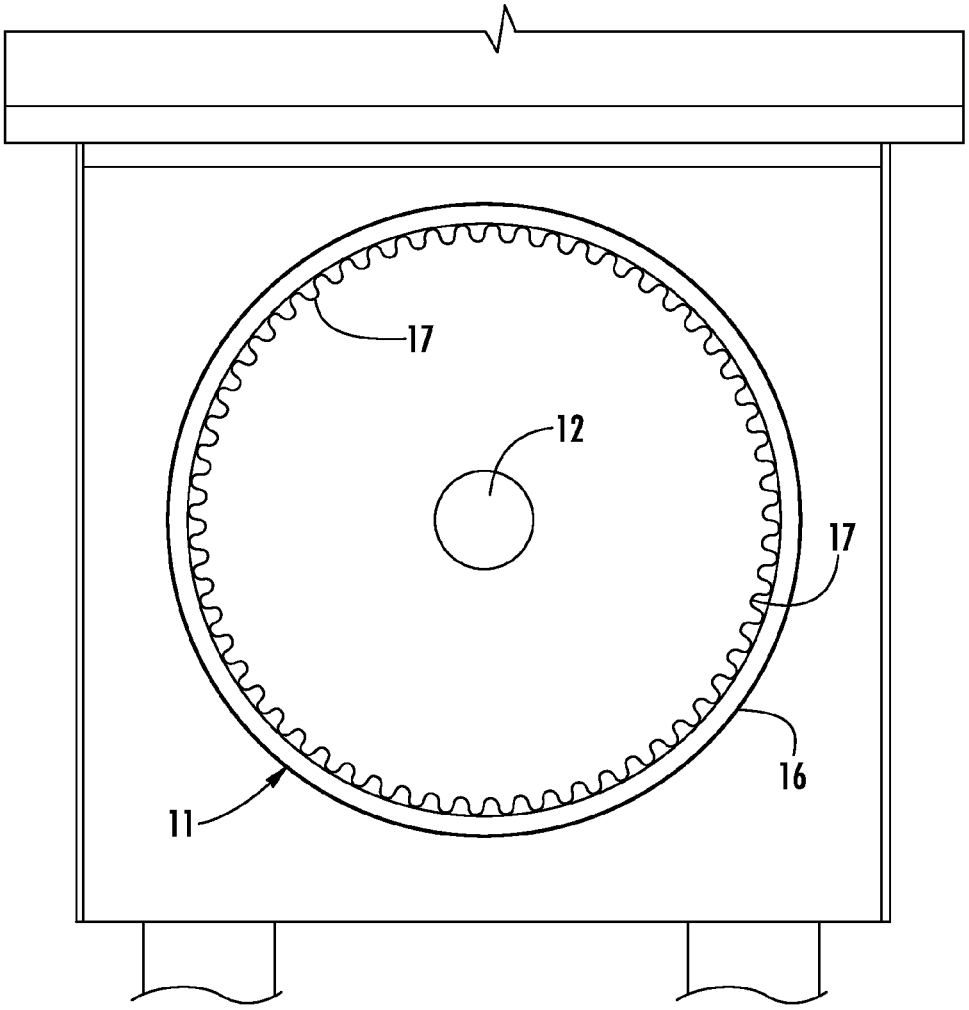
FIG. 5 is a top cross sectional view taken along lines 5-5 of FIG. 4.
Figure 6:
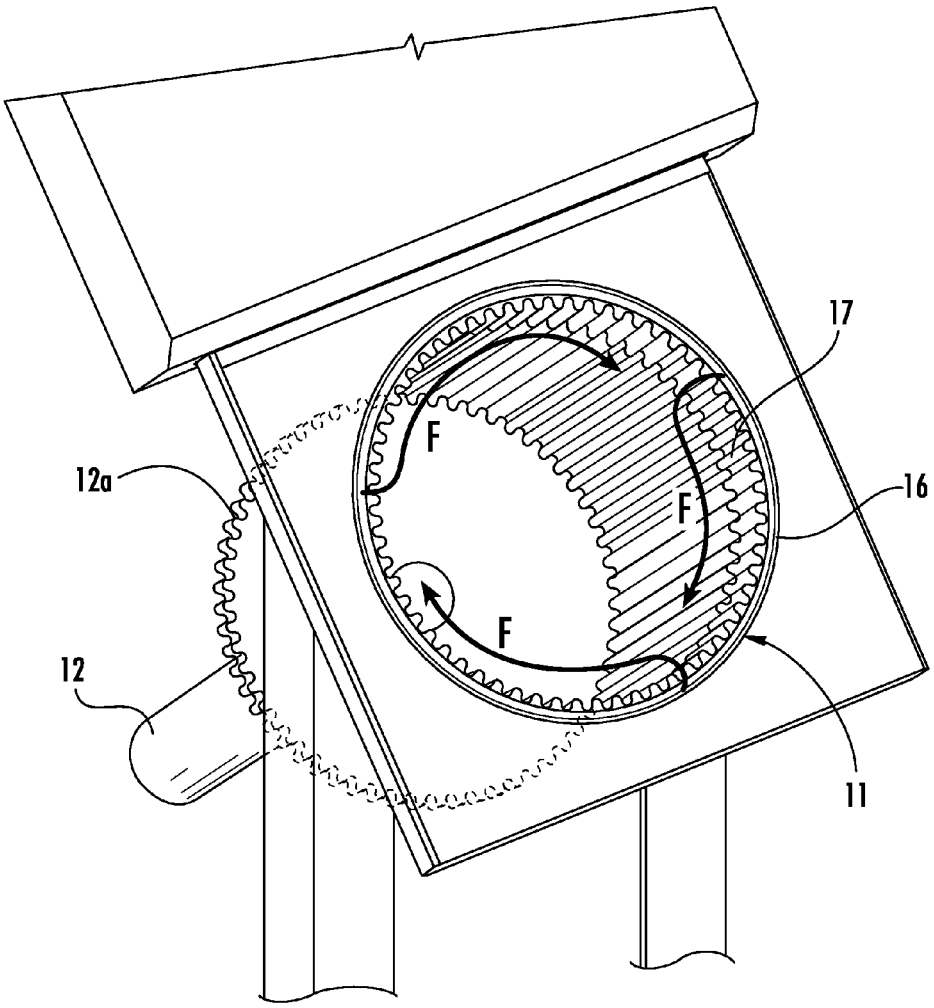
FIG. 6 is a perspective view of the system of FIG. 1.
Figure 7:
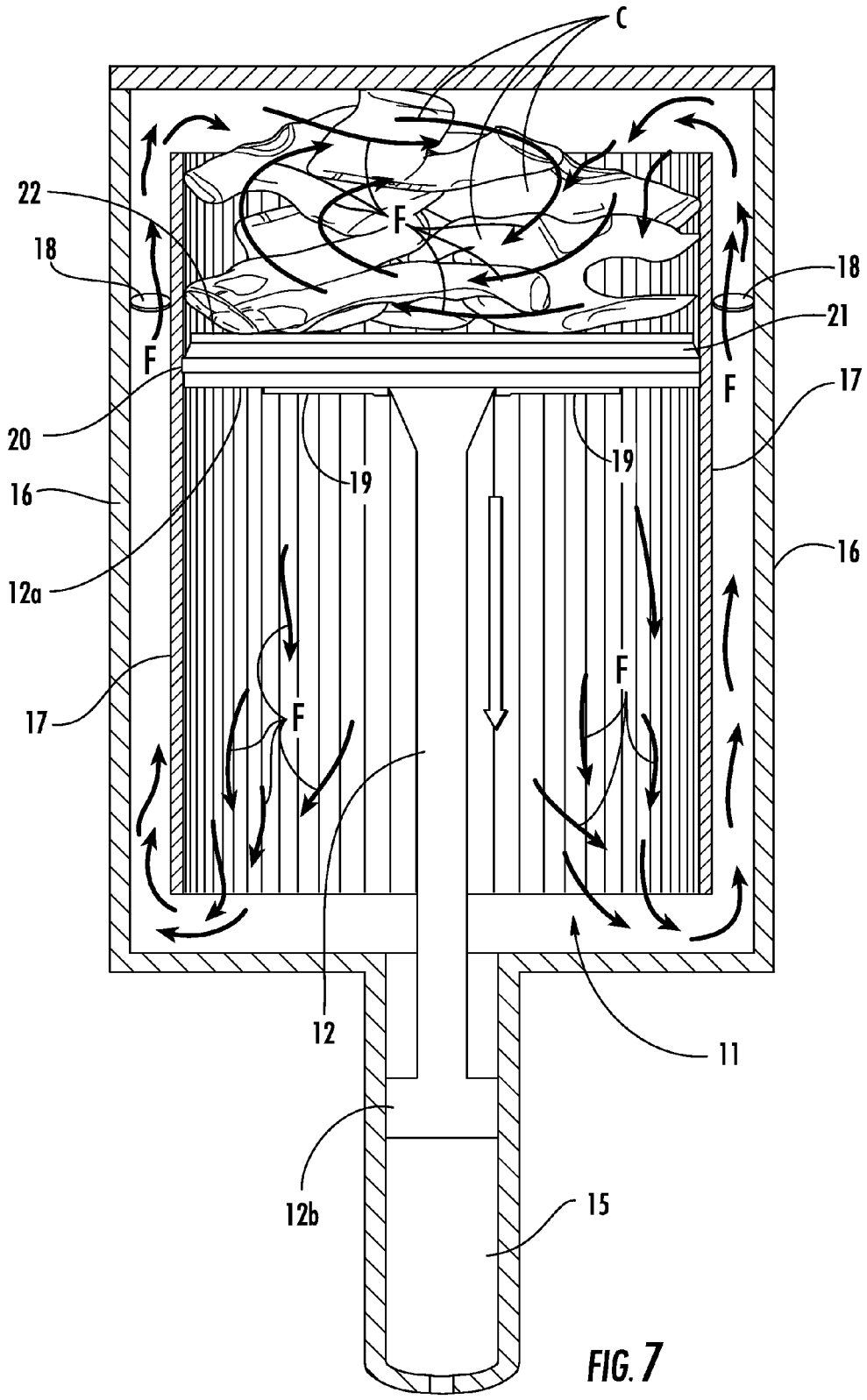
FIG. 7 is a schematic cross sectional view of the cleaning chamber of the system of FIG. 1.
Figure 9:
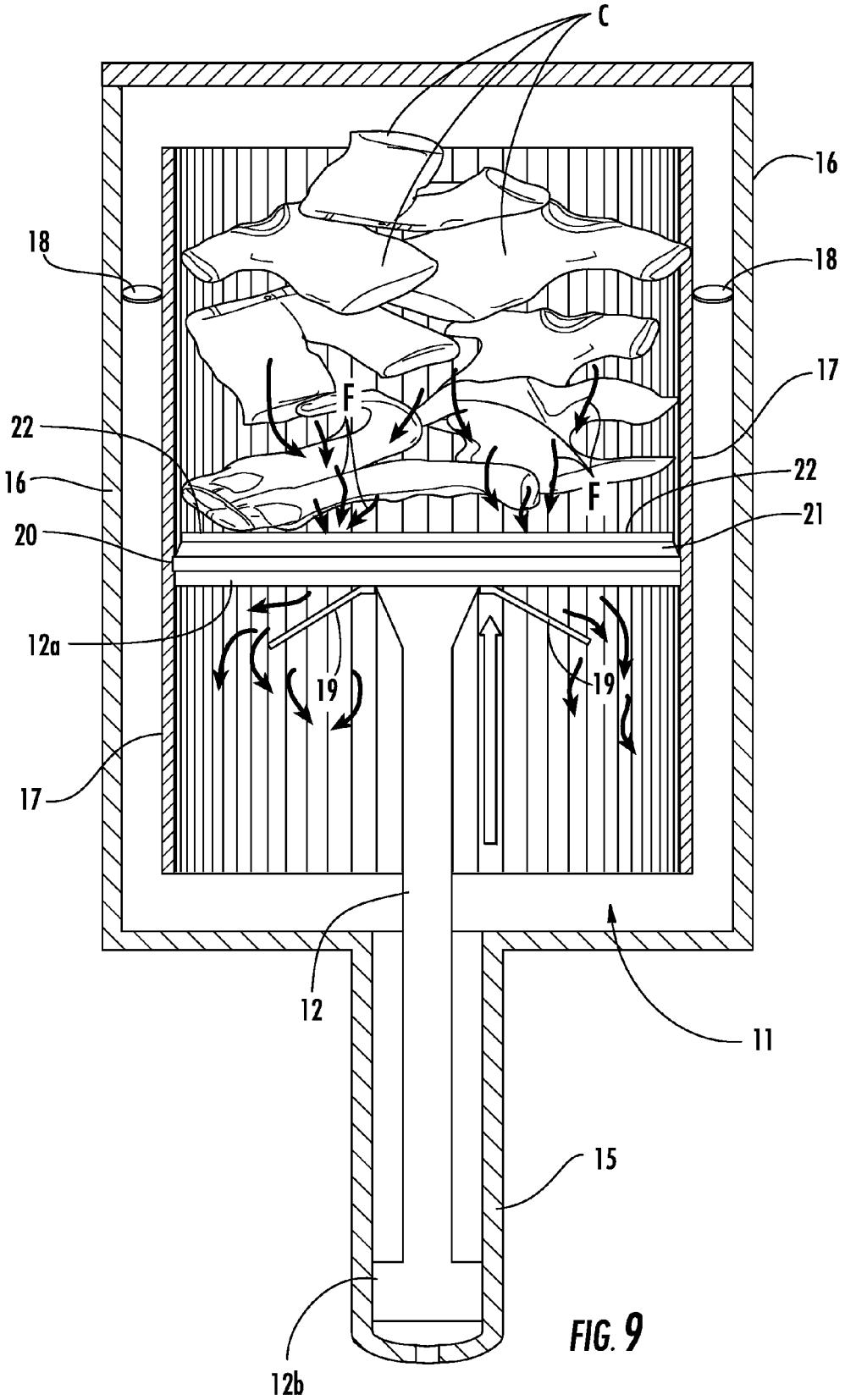
FIG. 9 is another schematic cross sectional view of the cleaning chamber of the system of FIG. 1.

As shown in FIGS. 5, 7 and 9, the chamber 11 can include an outer pressure wall 16 and an inner false wall 17. As shown in FIGS. 5 and 6, the inner false wall 17 can have a corrugated surface to provide additional frictional agitation of the clothes "C" within the chamber 11 as they are moved against the corrugated false wall 17 by reciprocating motion of the piston 12. The outer edge of the piston head 12*a* can be corrugated to conform to the corrugated inner false wall 17, as shown in FIG. 6.

As shown in FIGS. 7 and 9, a check valve 18 can be positioned between the outer pressure wall 16 and the inner false wall 17. The piston head 12*a* can include a check valve 19. A disk shaped, granulated carbon filter canister 20 can be positioned on the upper surface of the piston head 12*a*, and a particulate filtering membrane 21 can be positioned on the carbon disc 20. The filter membrane 21 can be made of plastic mesh, paper mesh, or other suitable material. The filter membrane 21 filters particulates such as lint and dust from the cleaning solvent, thus removing the necessity of having a second vessel for filtering. A grate 22 covers the filter 21 preventing clothes from directly contacting the filter 21. The carbon filter 20 positioned between the particulate filter 21 and the piston head 12*a* removes die from the cleaning solvent in the chamber 11.

Figure 8:
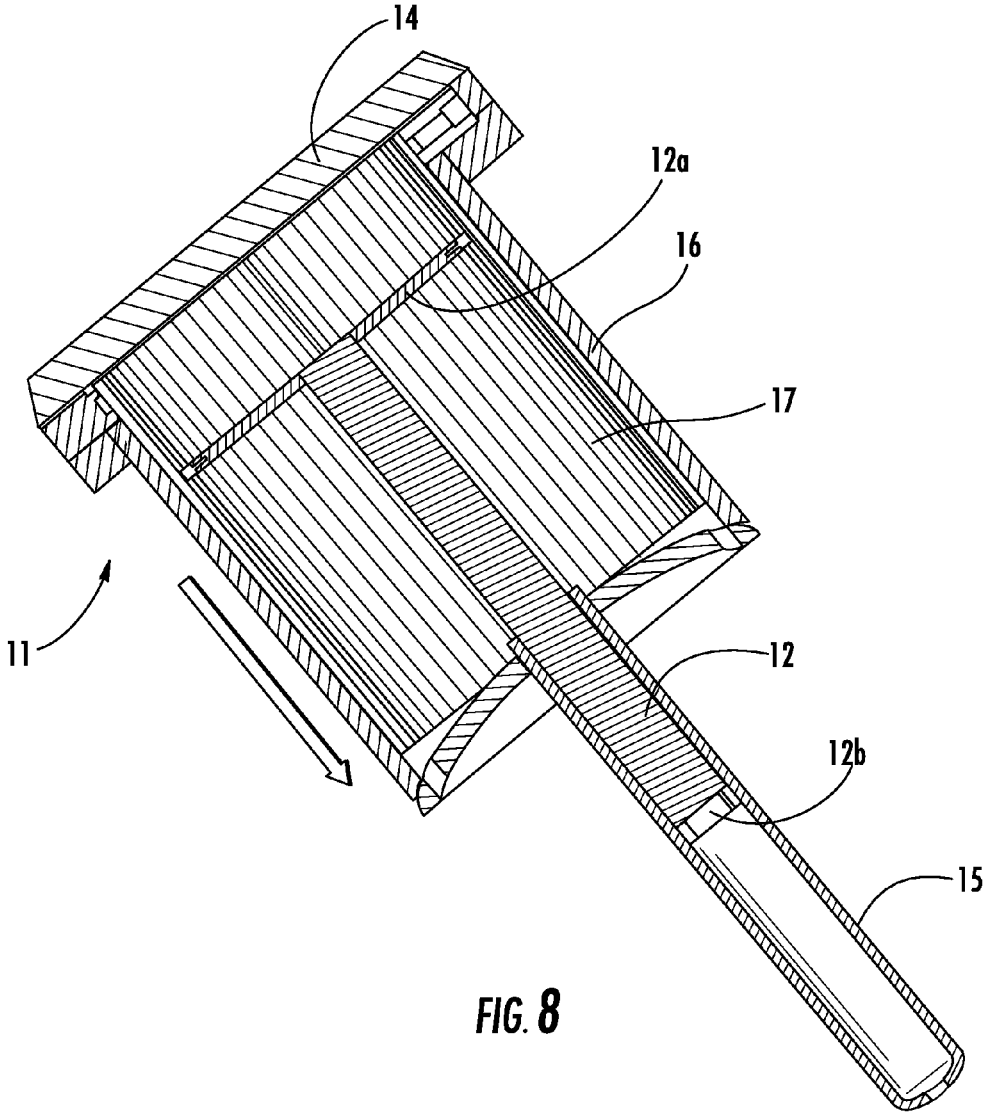
FIG. 8 is another cross sectional view of the cleaning chamber of the system of FIG. 1.
Figure 10:
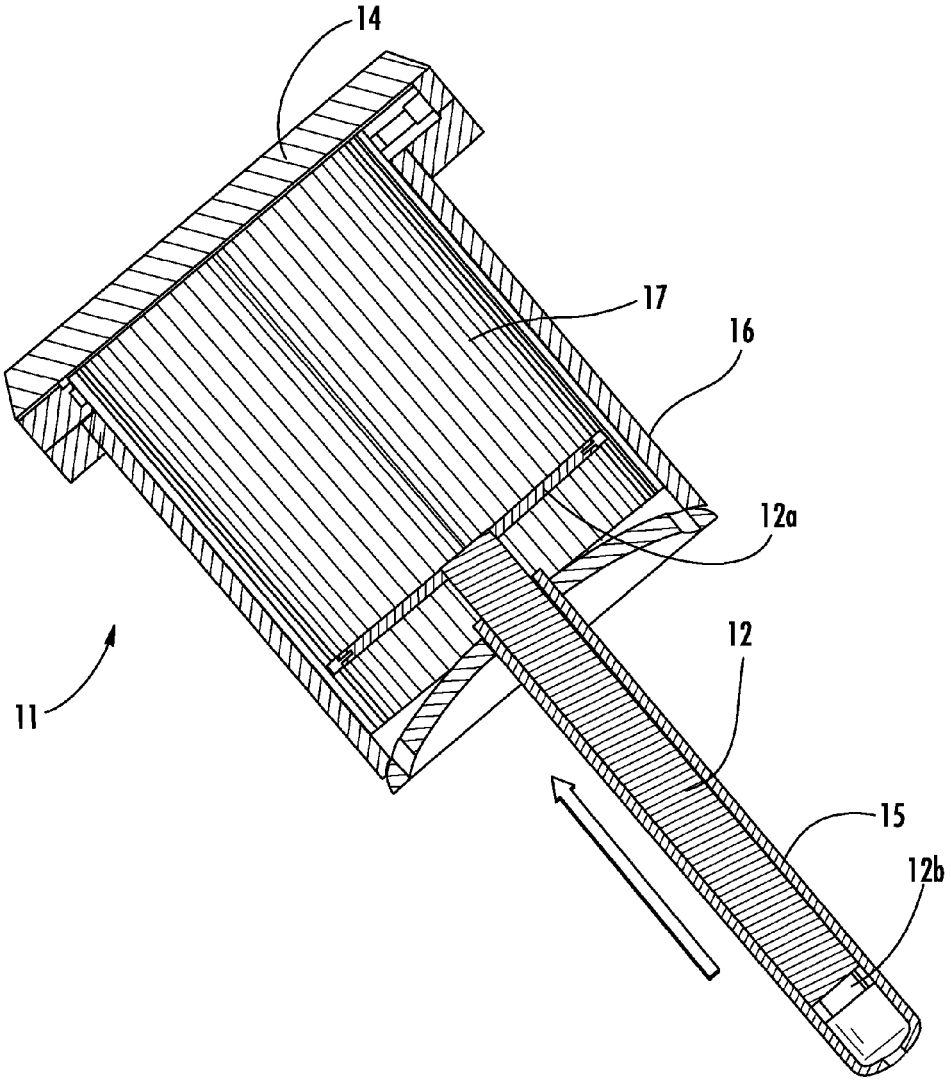
FIG. 10 is another cross sectional view of the cleaning chamber of the system of FIG. 1.

When the piston 12 moves down, as shown in FIG. 8, the piston head check valve 19 is closed, and the check valve 18 between the chamber outer wall 16 and inner false wall 17 opens, as shown in FIG. 7. Downward movement of the piston head 12*a* allows for the clothes "C", which are positioned above the piston head 12*a* in the chamber 11, to expand. Expansion of the compressed bundle of clothes "C" is assisted by tangential flow "F" of cleaning solvent from tangential ports in the inner false wall 17 and through the open check valve 18 so that cleaning solvent flows through and around the clothes, as shown in FIG. 7. The tangential flow "F" also imparts a centripetal force on the clothes "C", as shown in FIGS. 6 and 7, that causes the clothes "C" to spin and move toward the corrugated surface of the inner wall, thus increasing mechanical cleaning action. As the piston 12 reciprocates and moves upward, as shown in FIG. 10, the piston head check valve 19 opens allowing the flow "F" of cleaning solvent to flow through the piston head 12*a* as it is compressed out of the garments, as shown in FIG. 9. This action is repeated until the clothes "C" are satisfactorily cleaned.

In an alternative embodiment, a sieve piston can be utilized, rather than the piston head check valve 19, to facilitate the proper flow of the cleaning solvent. In another alternative embodiment, a solid piston can be utilized with plumbing that attaches proximate opposite ends of the chamber 11 to facilitate proper solvent flow.

When the cleaning process is completed, dirty used solvent is evacuated to the still 40. The still 40 can be positioned above the storage tank 30, which stores clean solvent. As such, hot gaseous solvent compressed into the storage tank 30 and rising to the top of the storage tank 30 heats up cool used dirty solvent at the bottom of the still 40, boiling the dirty liquid solvent and producing clean gaseous solvent. This leaves unwanted particulate residue to exit through an exit tube 42 connected to the still 40. Also, the gaseous solvent that is compressed into the storage tank 30 is condensed into liquid, thereby allowing for the storage tank 30 to be completely filled with solvent.

Cleaning processes using heated drying typically yield heat set wrinkles in the clothes that necessitate immediate tumble fluffing to remove. By utilizing a solvent such as liq$CO_2$, the piston agitation process of the system 10 of the present invention does not result in heat set wrinkles, thus eliminating the need for fluffing. It should be noted that the system 10 is not limited to use only with dry cleaning solvents. The system 10 can be used with other cleaning fluids, including water based cleaning formulations such as water and detergent. As such, the system 10 is operable in both dry cleaning and water wash modes.

It is believed that the piston agitation of the system 10 of the present invention provides greater mechanical cleaning action than prior art systems such as jet agitation and rotary basket systems. Because of the increased agitation, the cleaning times for each load can be reduced. Also, because fluff drying is not necessary with the system 10, more clothes can be cleaned in the chamber 11. Shorter cleaning times and increased load capacity allow for the cleaning chamber 11 to be smaller than in prior art systems. This results in the system 10 of the present invention being easier to transport and having a smaller installation footprint than larger prior art units.

It should be noted that while the system 10 is described as being used to clean clothes, the invention is not so limited. The system 10 can be used to treat clothes for purposes other than cleaning, such as dying. Furthermore, the system 10 can be used to treat a variety of items other than clothes, such as hardware.

A clothes treating apparatus and method are described above. Various changes can be made to the invention without departing from its scope. For example, while a preferred embodiment of the invention is described above as being used for cleaning clothes with a dry cleaning solvent such as liq$CO_2$, the invention is not so limited and can be used to treat a variety of items with a variety of treating fluids, including hydrous and anhydrous liquids. The above description of the preferred embodiments and best mode of the invention are provided for the purpose of illustration only and not limitation—the invention being defined by the following claims and equivalents thereof.

What is claimed is:

1. A cleaning apparatus comprising:

(a) a cleaning chamber having an inner wall and an outer wall with a space therebetween and adapted for receiving and containing clothes and a cleaning fluid therein; and (b) a piston having a piston head positioned within the cleaning chamber adapted for reciprocating motion within the cleaning chamber, wherein reciprocal motion of the piston head agitates the clothes contained within the cleaning chamber thereby facilitating cleaning of the clothes, wherein the piston is adapted for reciprocal linear motion within the cleaning chamber, wherein the piston has an axis corresponding to a direction of reciprocal linear motion of the piston, and wherein an axis of the inner wall and outer wall is coaxial with the axis of the piston, and the piston head moves in a first linear motion compressing the clothes within the cleaning chamber, and the piston head moves in a second linear motion opposite the first linear motion allowing the clothes within the cleaning chamber to expand.

2. The apparatus according to claim 1, wherein the inner wall is positioned within the cleaning chamber and defines a clothes receiving area for receiving and containing the clothes therein, and wherein the outer wall surrounds the inner wall, whereby the space between the inner wall and the outer wall define an intermediate area, and an outer edge of the piston head is proximate and conforms to the inner wall.

3. The apparatus according to claim 2, wherein the inner wall has a corrugated surface facing the clothes receiving area, wherein a tangential flow of the cleaning fluid imparts a centripetal force on the clothes, whereby the clothes are moved toward the corrugated surface of the inner wall.

4. The apparatus according to claim 2, wherein the cleaning chamber is substantially cylindrical and the outer wall and inner wall are substantially cylindrical, and the cleaning chamber includes a first opening at one end of the inner wall and outer wall for receiving the clothes therethrough, and the cleaning chamber has a second opening opposed to the first opening, and the apparatus further comprises a moveable door covering the first opening for selectively opening and closing the cleaning chamber, and wherein the piston is movable such that the piston head moves to the first opening for unloading clothes automatically from the cleaning chamber.

5. The apparatus according to claim 2, further comprising a filter disposed on the piston head for filtering treating fluid in response to motion of the piston in a first direction to compress clothes in the cleaning chamber, a first valve, responsive to movement of the piston head in the first direction to allow cleaning fluid to flow through the filter and past the piston head, and a second valve, responsive to movement of the piston head in the first direction, to block flow of cleaning fluid through the intermediate area between the inner and outer walls, the second valve being positioned in the intermediate area between the outer wall and the inner wall, and wherein the first valve is adapted to block flow of cleaning fluid in the first direction past the piston head in response to movement of the piston head in a second direction opposite the first direction, and the second valve is adapted for opening in response to movement of cleaning fluid through the intermediate area between the outer wall and the inner wall in response to movement of the piston head in the second direction.

6. The apparatus according to claim 1, wherein the cleaning fluid is selectable from the group consisting of a dry cleaning solvent and a water based cleaning formulation, whereby the apparatus is operable in dry cleaning and water wash modes.

7. The apparatus according to claim 1, further comprising:
(a) a storage tank for storing the cleaning fluid, the tank in communication with the cleaning chamber; and
(b) a still positioned above the storage tank in communication with the cleaning chamber for receiving used cleaning fluid.

8. The apparatus according to claim 7, wherein the cleaning fluid comprises a dry cleaning solvent, and the solvent in the storage tank is hotter than the used cleaning solvent in the still, whereby heat from the storage tank evaporates the used liquid cleaning solvent in the still producing clean gaseous solvent, and particulate residue, and further comprising an exit tube connected to the still for exiting the particulate residue, wherein the cleaning solvent comprises liquid carbon dioxide.

9. A clothes treating system comprising:
(a) a treating chamber for receiving a treating fluid therein, and having a first wall defining a clothes receiving area for receiving and containing clothes therein, the first wall having an inner surface facing the clothes receiving area; and
(b) a piston having a piston head positioned within the clothes receiving area adapted for reciprocating motion within the clothes receiving area, whereby reciprocal motion of the piston agitates the clothes contained within the clothes receiving area, and the surface of the first wall provides frictional agitation of the clothes as the clothes are moved against the inner surface by the reciprocal motion of the piston head,
wherein the piston is adapted for reciprocal linear motion within the cleaning chamber, wherein the piston has an axis corresponding to a direction of reciprocal linear motion of the piston, an axis of the first wall is coaxial with the axis of the piston, and an outer edge of the piston head is proximate and conforms to the inner surface of the first wall,
wherein there is a filter disposed on the piston head for filtering treating fluid in response to motion of the piston in a first direction.

10. The system according to claim 9, wherein the inner surface of the first wall is corrugated, the piston head slides back and forth within the clothes receiving area, and the piston head includes a corrugated outer edge adapted for complimentary sliding engagement with the corrugated inner surface of the first wall.

11. The system according to claim 9, further comprising:
(a) a storage tank for storing the treating fluid, the tank in communication with the treating chamber and the treating fluid comprising a dry cleaning solvent;
(b) a still positioned above the storage tank in communication with the cleaning chamber for receiving used cleaning solvent; and
(c) wherein the cleaning solvent in the storage tank is hotter than the used solvent in the still, whereby heat from the storage tank evaporates the used liquid solvent in the still producing clean gaseous solvent, and particulate residue.

12. The system according to claim 9, wherein the treating chamber comprises a second wall surrounding the first wall, the second wall defining an outer wall, and the first wall is contained within and coaxial with the outer wall, and the first wall and the outer wall define an intermediate area there between.

13. The system according to claim 9, further comprising a compressor operatively connected to the treating chamber for moving the treating fluid throughout the system, and wherein the compressor is lubricated by an ester-based detergent, wherein the detergent is in controlled communication with and released by controlled release to the liquid cleaning solvent for the cleaning chamber.

14. A method of treating clothes with a cleaning fluid comprising:
(a) providing an apparatus comprising:
(i) a cleaning chamber adapted for receiving and containing clothes and a cleaning fluid therein, and having an opening for receiving clothes therethrough,
(ii) a moveable door covering the chamber opening for selectively opening and closing the opening,
(iii) a piston having a piston head positioned within the cleaning chamber adapted for reciprocating linear motion within the cleaning chamber,
(iv) a storage tank storing the cleaning fluid in communication with the cleaning chamber, and
(v) a still positioned above the storage tank in communication with the cleaning chamber for receiving used cleaning solvent;
(b) opening the door and introducing clothes through the chamber opening;
(c) closing the door;
(d) introducing the cleaning fluid from the storage tank into the cleaning chamber; and
(e) moving the piston head in reciprocal linear motion to agitate the clothes within the cleaning chamber,
wherein there is a step of using a detergent in the cleaning fluid, and a step of using the detergent as a lubricant for a power source for moving the piston.

15. The method of claim 14, further comprising:

(a) opening the door; and (b) moving the piston head toward the chamber opening, whereby the clothes are moved out of the cleaning chamber.

16. The apparatus according to claim 2, wherein the cleaning chamber includes a first opening at one end of the inner wall and outer wall for receiving the clothes therethrough and the intermediate area communicates with a first portion of the cleaning chamber inside the inner wall proximate the first opening, and the cleaning chamber has a second opening opposed to the first opening, and wherein the intermediate area also communicates with a second portion of the cleaning chamber inside the inner wall proximate the second opening, whereby cleaning fluid may be circulated from the second portion of the cleaning chamber proximate the second opening through the intermediate area back into the first portion of the cleaning chamber proximate the first opening during reciprocal motion of the piston.

17. The system according to claim 12, wherein the inner wall is positioned within the cleaning chamber and defining a clothes receiving area for receiving and containing the clothes therein, wherein the cleaning chamber includes a first opening at one end of the inner wall and outer wall for receiving the clothes therethrough and the intermediate area communicates with a first portion of the cleaning chamber inside the inner wall proximate the first opening, and the cleaning chamber has a second opening opposed to the first opening, and wherein the intermediate area also communicates with a second portion of the cleaning chamber inside the inner wall proximate the second opening, whereby cleaning fluid may be circulated from the second portion of the cleaning chamber proximate the second opening through the intermediate area back into the first portion of the cleaning chamber proximate the first opening during reciprocal motion of the piston.

18. The system according to claim 9, wherein the cleaning chamber is substantially cylindrical and the outer wall and inner false wall are substantially cylindrical, and the cleaning chamber includes a first opening at one end of the inner false wall and outer wall for receiving the clothes therethrough, and the cleaning chamber has a second opening opposed to the first opening, and the apparatus further comprises a moveable door covering the first opening for selectively opening and closing the cleaning chamber, and wherein the piston is movable such that the piston head moves to the first opening for unloading clothes automatically from the cleaning chamber.

19. The apparatus according to claim 1, wherein the cleaning fluid comprises liquid carbon dioxide.

20. The system according to claim 9, wherein the cleaning fluid comprises liquid carbon dioxide.

21. A clothes treating system comprising:

(a) a treating chamber for receiving a treating liquid therein, and having an inner liquid barrier defining a clothes receiving area for receiving and containing clothes therein, the inner liquid barrier having a surface facing the clothes receiving area; and (b) a piston having a piston head positioned within the clothes receiving area adapted for reciprocating motion within the clothes receiving area in a first direction to compress the clothes and in a second direction opposite the first direction, whereby reciprocal motion of the piston agitates the clothes contained within the clothes receiving area, and the surface of the inner liquid barrier provides frictional agitation of the clothes as the clothes are moved against the surface by the reciprocal motion of the piston head, wherein the piston has an axis corresponding to the first and second directions, and wherein the inner liquid barrier extends in the first and second directions, and an outer edge of the piston head is proximate and conforms to the surface of the inner liquid barrier, wherein outside of the inner liquid barrier with respect the clothes receiving area there is an outer liquid barrier defining a space there between, the space extending in the first and second directions and having a first end portion communicating with a first portion of the clothes receiving area on a leading portion of the piston head when the piston is moving in the first direction, and a second end portion communicating with a second portion of the clothes receiving area opposite the first portion of the clothes receiving area, wherein there is (i) a filter disposed on the piston head for filtering treating liquid in response to motion of the piston in the first direction to compress clothes in the cleaning chamber, (ii) a first valve which is responsive to movement of the piston head in the first direction to allow cleaning liquid to flow through the filter and past the piston head in the second direction, and (iii) a second valve which is responsive to movement of the piston head in the first direction to block flow of cleaning liquid in the second direction through the space, the second valve being positioned in the space, and wherein the first valve is adapted to block flow of cleaning liquid in the first direction past the piston head in response to movement of the piston head in the second direction, and the second valve is adapted for opening in response to movement of cleaning liquid through the space in the first direction in response to movement of the piston head in the second direction, whereby cleaning liquid is filtered and circulated in the treating chamber by moving in the second direction from the clothes receiving area then to the second end portion of the space and through the space in the first direction to the first end portion of the space and back into the clothes receiving area.

22. The system according to claim 21, wherein the surface of the inner liquid barrier comprises corrugations and the outer edge of the piston head has corrugations conforming thereto.

23. A clothes treating system comprising:

(a) a treating chamber for receiving a treating fluid therein, and having a first wall defining a clothes receiving area for receiving and containing clothes therein, the first wall having an inner surface facing the clothes receiving area; and (b) a piston having a piston head positioned within the clothes receiving area adapted for reciprocating motion within the clothes receiving area, whereby reciprocal motion of the piston agitates the clothes contained within the clothes receiving area, and the surface of the first wall provides frictional agitation of the clothes as the clothes are moved against the inner surface by the reciprocal motion of the piston head, wherein the piston is adapted for reciprocal linear motion within the cleaning chamber, wherein the piston has an axis corresponding to a direction of reciprocal linear motion of the piston, an axis of the first wall is coaxial with the axis of the piston, and an outer edge of the piston head is proximate and conforms to the inner surface of the first wall, wherein the inner surface of the first wall is corrugated, the piston head slides back and forth within the clothes receiving area, and the piston head includes a corrugated outer edge adapted for complimentary sliding engagement with the corrugated inner surface of the first wall.

* * * * *